United States Patent [19]

Philippe et al.

[11] Patent Number: 4,994,788

[45] Date of Patent: Feb. 19, 1991

[54] SYSTEM FOR COLLECTING ALARMS FROM A SET OF STATIONS

[75] Inventors: Dominique Philippe, Begard; Jean-Yves Cozic, Lannion, both of France

[73] Assignee: Societe Anonyme dite: Alcatel Cit, Paris, France

[21] Appl. No.: 412,375

[22] Filed: Sep. 26, 1989

[30] Foreign Application Priority Data

Sep. 26, 1988 [FR] France ..... 88 12534

[51] Int. Cl.[5] ..... G08B 26/00

[52] U.S. Cl. ..... 340/505; 340/518; 340/514; 340/825.06; 340/825.05

[58] Field of Search ..... 340/505, 508, 506, 518, 340/514, 825.06, 825.05, 825.54, 825.07-825.13; 370/85.5, 85.8, 85.12, 85.15

[56] References Cited

U.S. PATENT DOCUMENTS

| | | | |
|---|---|---|---|
| 3,516,063 | 6/1970 | Arkin et al. | 340/825.07 |
| 3,715,725 | 2/1973 | Kievit et al. | 340/825.07 |
| 4,290,055 | 9/1981 | Furney et al. | 340/505 |
| 4,468,664 | 8/1984 | Galvin | 340/505 |
| 4,568,919 | 2/1986 | Muggli et al. | 340/505 |
| 4,603,318 | 7/1986 | Philp | 340/505 |
| 4,617,566 | 10/1986 | Diamond | 340/825.05 |

FOREIGN PATENT DOCUMENTS 2080000 1/1982 United Kingdom .

OTHER PUBLICATIONS

I.E.E. Proceedings—/G. Electronic Circuits and Systems, vol. 135, No. 1, Part G, Feb. 1988, Stevenage, Herts., GB; A. J. Al-Khalili et al.: "Multiple Single--Chip Microcomputer Approach to Tire Deflection and Monitoring System", pp. 1-10.

*Primary Examiner*—Donnie L. Crosland

*Attorney, Agent, or Firm*—Sughrue, Mion, Zinn, Macpeak & Seas

[57] ABSTRACT

A system for collecting alarms from a set of stations includes a central station (SC) connected in series with the stations over a loop link includes a message loop (BM), a clock signal loop (BH), and a state control loop (BCE). Each station includes an interface (5) connected to the various loops of the link. The message loop conveys messages transmitted by the central station and intended for at least one of the interfaces, replies from the interfaces, and messages transmitted by the interfaces and intended for the central station. The clock signal loop conveys a clock signal transmitted by the central station and the state control loop conveys a state control signal also transmitted by the central station, the signal taking a first value for an active operating mode of the interfaces and a second value for a standby operating mode of the interfaces. Changing over from the first value to the second also serves to reset the interfaces to zero. The clock signal and the state control signal travel round the loop in one direction while messages travel round the loop in the opposite direction.

15 Claims, 6 Drawing Sheets

SYSTEM FOR COLLECTING ALARMS FROM A SET OF STATIONS

The invention relates to interrogating the various stations in a set of stations for the purpose of establishing their operating state.

BACKGROUND OF THE INVENTION

The term "station" is used to designate any electronic control or monitoring device, automatic work station, or computer, forming a part, for example, of a manufacturing line, of a set of computers interconnected by a bus, or of a telecommunications exchange in which the "stations" are electronic devices such as registers, call chargers, markers, translators, control units, or connection units all connected to a switching network. The stations can thus dialog with one another, or be independent, or be under the control of a central control unit.

A station may emit warning signals, with each warning signal having a precise meaning such as some parameter or value reaching a threshold, or wrong operation, or a breakdown of a unit in the station. The term "alarm" is used below for any fault or breakdown that is signalled. A knowledge of such alarms provides information on the operating state of the station.

Alarms are generally conveyed by cables to a central station where they are analyzed; thereby concentrating cabling by an amount which depends on the number of stations and on the number of alarms per station, with all the drawbacks that stem therefrom, in particular bulky cabling and high cost.

An object of the invention is to collect alarms from stations in a set of stations without suffering the drawbacks of such alarms being collected by individual cabling.

SUMMARY OF THE INVENTION

The present invention provides a system for collecting alarms from a set of n stations each specified by an address, the system comprising:

a central station where alarms are brought together;

at least one interface at each station for collecting the alarms of that station; and a loop link interconnecting the central station and the interface in series, said loop link comprising:

- a message loop conveying messages transmitted by the central station to at least one of the interfaces, replies from each destination station, and messages emitted by the interfaces to the central station;
- a state control loop conveying a state control signal delivered by the central station to set an active or a standby operating mode in all of the interfaces, said state control signal having a first value for the active operating mode and a second value for the standby operating mode; and
- a clock signal loop conveying a clock signal delivered by the central station to all of the interfaces.

BRIEF DESCRIPTION OF THE DRAWINGS

An embodiment of the invention is described by way of example with reference to the accompanying drawings, in which.

DETAILED DESCRIPTION

Figure 1:
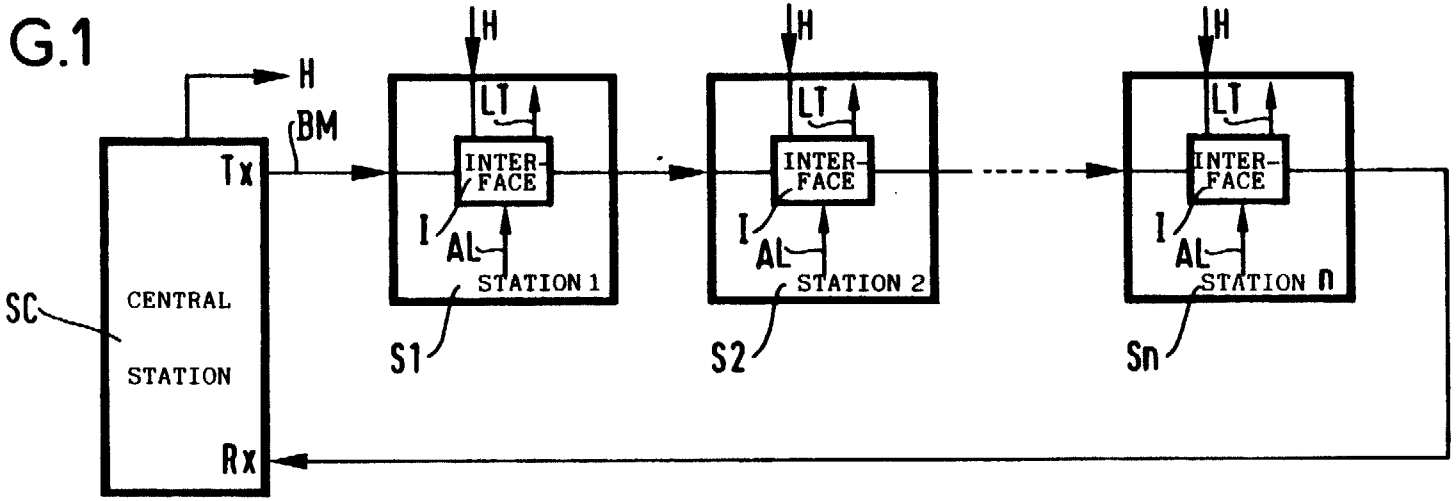
FIG. 1 is a theoretical diagram of a system of the invention for collecting alarms.

FIG. 1 is a diagram of a system in accordance with the invention. A central station SC for collecting alarms is connected in series with a set of n stations S1 to Sn via a message loop BM which is an asynchronous serial link. Each of the stations S1 to Sn is identified by an address which is a number, with the order in which the stations are connected not necessarily corresponding to the order of their addresses, with the first station S1 in the set of stations being connected to a transmit terminal Tx of the central station, and with the last station Sn of the said set of stations being connected to a receive terminal Rx of the central station. Each station includes an interface I having an input and an output connected in the message loop BM. Each interface receives a clock signal H required for its operation from the central station, and each groups together the alarms from the corresponding station which are applied thereto over an alarm link AL. The alarms are transmitted over the message loop BM following a message emitted by the central station SC.

Figure 2:
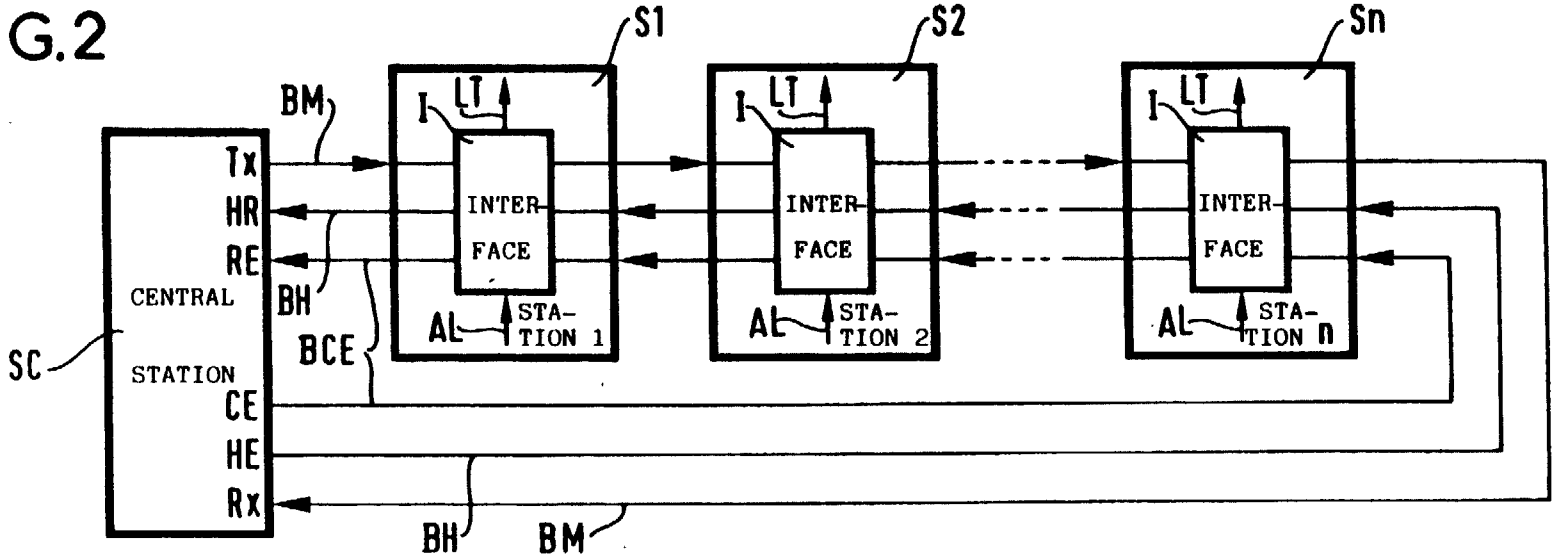
FIG. 2 shows one embodiment of a system of the invention.

FIG. 2 shows an embodiment of the FIG. 1 system. The central station SC and the stations S1 to Sn are connected in series, as in FIG. 1, by the message loop BM. They are also connected in series by a clock signal loop BH and a state control loop BCE. The last station Sn of the set of stations is connected via these two loops to a transmit terminal HE and a transmit terminal CE of the central station, said terminals transmitting a clock signal and a state control signal, respectively. The first station S1 of the set of stations is connected via these two loops to a receive terminal HR for the clock signal and to a receive terminal RE for the state control signal, both receive terminals belonging to the central station SC.

Within the stations, the loops BH and BCE are connected to the interfaces I.

The loops BM, BH, and BCE are combined to form a single cord between pairs of stations, and between the central station and one of the stations. If the cord is broken, those stations which are situated upstream from the break continue to receive the clock signal ("upstream" being relative to the direction in which messages travel over the loop BM), and continue to be capable of transmitting, as described below. Similarly, these stations can continue to receive the state control signal via the loop BCE.

In FIGS. 1 and 2, each interface is connected to the station via a remote control link LT over which it delivers remote control instructions sent by the central station over the message loop BM.

Figure 3:
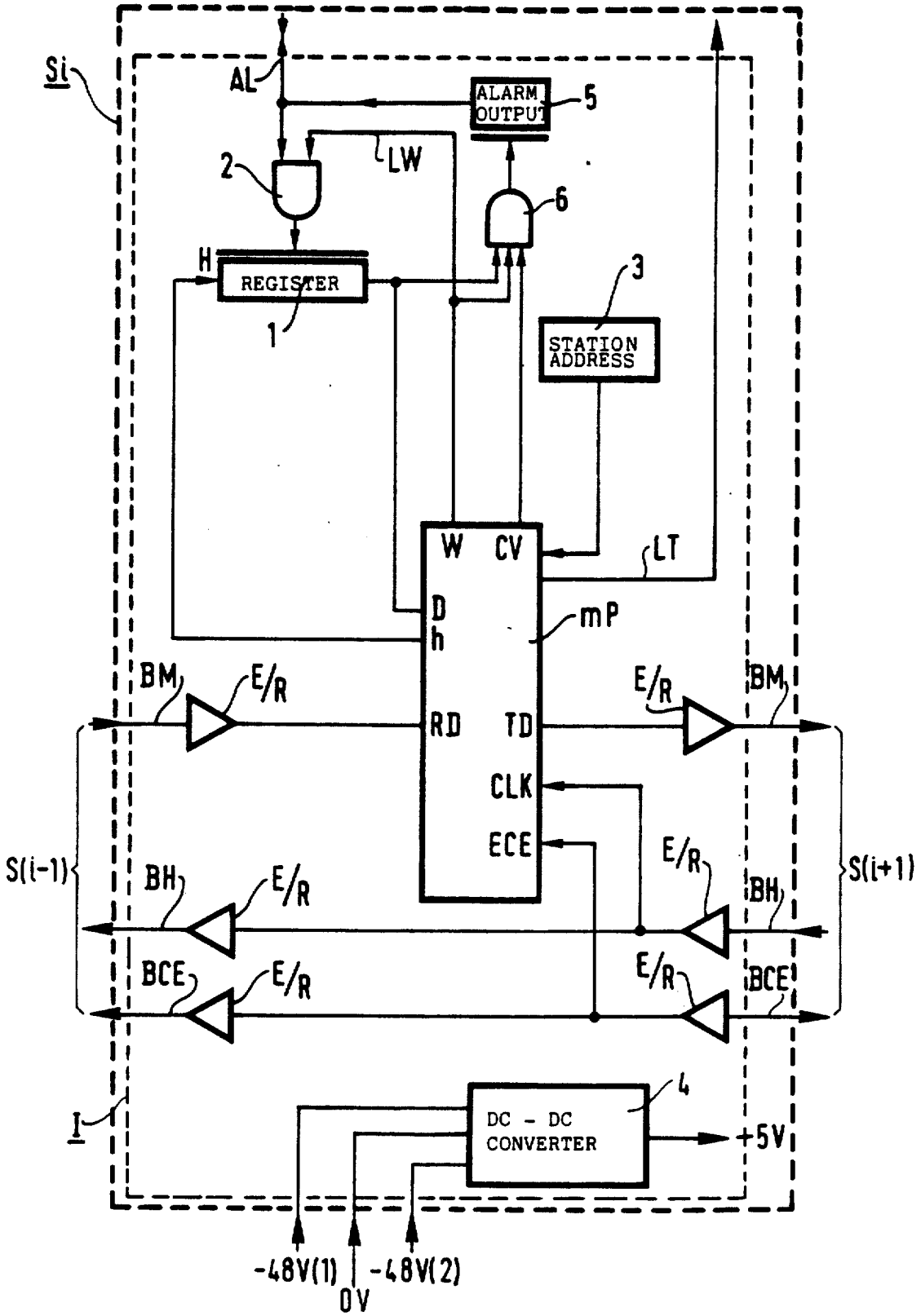
FIG. 3 shows an interface for each station in a system of the invention.

FIG. 3 shows an interface I of a station Si, with all of the station interfaces being identical. In this figure, mP represents a microprocessor together with its memories, be they internal or external relative to the microprocessor, 1 represents a parallel/serial register, 2 an AND gate, 3 a station addressing circuit, with the address being a number given, for example, by hard wiring, and E/R are transmitters/receivers.

To the right of the figure, the lops BM, BH, and BCE are connected to station S(i+1); and to the left of the figure they are connected to the station S(i−1). The microprocessor mP has a read input RD connected to the message loop BM via a transmitter/receiver E/R, a transmit output TD connected to the message loop BM via a transmitter/receiver, a clock input CLK connected to the clock signal group BH via a transmitter/receiver whose output is connected via another transmitter/receiver to the clock signal loop connected to the station S(i−1), and a state control input ECE connected to the state control signal loop BCE by a transmitter/receiver whose output is connected via another transmitter/receiver to the state control signal loop BCE connected to the station S(i−1). It can be seen that the microprocessor mP is, so to speak, connected in series with the message loop BM whereas it may be considered as being in parallel relative to the clock signal loop BH and the state control signal loop BCE. The microprocessor mP also has a remote control output connected to the station via a remote control link LT.

The parallel/serial register 1 has a parallel input connected to the output of AND gate 2 which has one input connected to the alarm links AL that convey the alarm signals of the station, and another input is connected via a write link LW to a write output W of the microprocessor mP which uses said write link to deliver the instruction to write the alarms into the register 1. A serial output from the register 1 is connected to a data input D of the microprocessor. A clock input of the register 1 is connected to a clock output h of the microprocessor mP which delivers a clock signal H on said output in order to reach the register 1. This clock signal is applied only after the write signal and it is removed once the register 1 has been read. The alarm link Al may be a 16-line link, for example, with one line per alarm. The register 1 is then a 16-bit register, and in this case the clock signal H must be applied for a time of not less than 16 periods of the clock signal in order to shift the bits of the register to its output. After it has been read, all of the bits in the register are at zero and the register is again ready to receive alarms on instructions from the microprocessor.

The alarm link AL is also connected to the output of an alarm circuit 5. It is then connected to an indicator lamp control circuit, which control circuit (not shown) is situated in the station and serves to control the switching on of indicator lamps grouped together in a room from which the stations are supervised. The alarm output circuit 5 is a register connected to the output of an AND gate 6 whose input is connected to the data input D, to the write output W, and to a control output CV of the microprocessor which uses said control output CV for delivering indicator lamp setting instructions.

When the interface I is used for collecting alarms, the register 5 serves for testing the alarm link AL on line.

When the interface I is used for setting alarm indicator lamps, the register 5 serves to specify the states of the lamps, and in this case the alarm link AL constitutes an output from the interface I and feeds the indicator lamp control circuit. In this case the interface I does not collect alarms.

The station address circuit 3 contains the address of the station, which address is a number determined, for example, by hard writing. The output of this circuit is connected to a station address input of the microprocessor mP.

Each interface includes a converter 4 which delivers +5V D.C. For reasons of operating security, the converter 4 has two independent feeds, −48V(1) and −48V(2), both at −48 volts. These two feeds are coupled together by diodes at the input to the converter.

Figure 4:
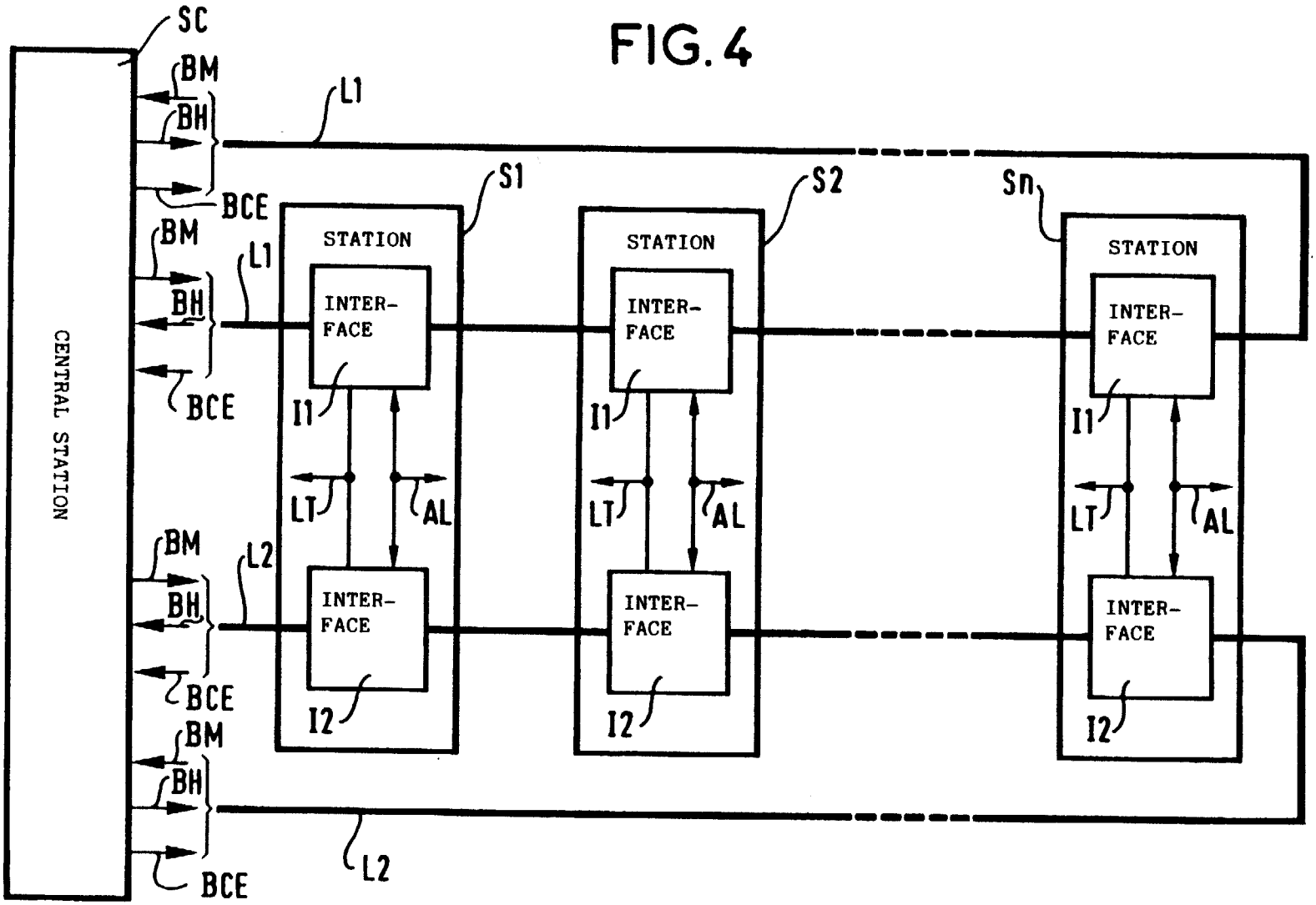
FIG. 4 shows another embodiment of a system in accordance with the invention.

FIG. 4 shows another embodiment of the system of the invention.

In FIG. 4, each of the stations S1 to Sn has two identical interfaces I1 and I2. The interfaces I1 are connected to the central station SC by a link L1 comprising a message loop BM, a clock signal loop BH, and a state control loop BCE. The interfaces I2 are connected to the central station SC by a link L2 comprising a message loop BM, a clock signal loop BH, and a state control loop BCE. The circuit operates in active/standby mode, with switching to one or other of the links L1 and L2 taking place either as a periodic task or else when an anomaly is detected on the active system.

The state control signal delivered by the central station SC on the state control loop BCE of each link L1 and L2 sets the active or standby mode of operation for the interfaces depending on whether the signal is at value 1 or at value 0. The switchover from active to standby, i.e. from value 1 to value 0 in the state control signal, also resets the interfaces to 0, thereby initializing them.

In the interfaces, a 1 value control signal enables the microprocessor outputs for remote control and for controlling the setting of the indicator lamps, whereas a 0 value control signal inhibits these outputs.

In the circuit shown in FIG. 2, a control signal puts all of the interfaces into active mode or into standby mode, with standby mode preventing any remote control of the stations and any control of the indicator lamps by the stations.

In the circuit shown in FIG. 4, since each station has two interfaces I1 and I2, when the interfaces I1 are active the interfaces I2 are on standby, and vice versa, and as a result it is always possible for the central station SC to issue remote control signals and to have indicator lamps set by the stations even in the event of one of the links L1 or L2 being interrupted or in the event of one of the interfaces I1 or I2 being faulty.

Except in the event of an anomaly, information is interchanged between the stations and the central station SC on the initiative of said central station which sends messages to the stations.

These message comprise:

read alarms: this message enables the central station to find out what alarms have been collected by the interfaces I in the stations;

execute remote controls: this message causes an action to be performed in each destination station;

set indicator lamps: this message causes alarm indicator lamps in each destination station to be switched on;

non-identified bytes: this message is transmitted spontaneously by a station which has not received anything for a certain length of time, or which has received two non-identified bytes in succession;

test: this message enables the central station to ensure that the interfaces I are operating properly; and initialization: this message informs the central station SC about the configuration of the message loop, i.e.

the order in which the stations follow one another, and the operating state of the circuit as a whole.

Following a message transmitted by the central station, the stations successively insert their responses, with the message and the responses being received by the central station SC.

Figure 5:
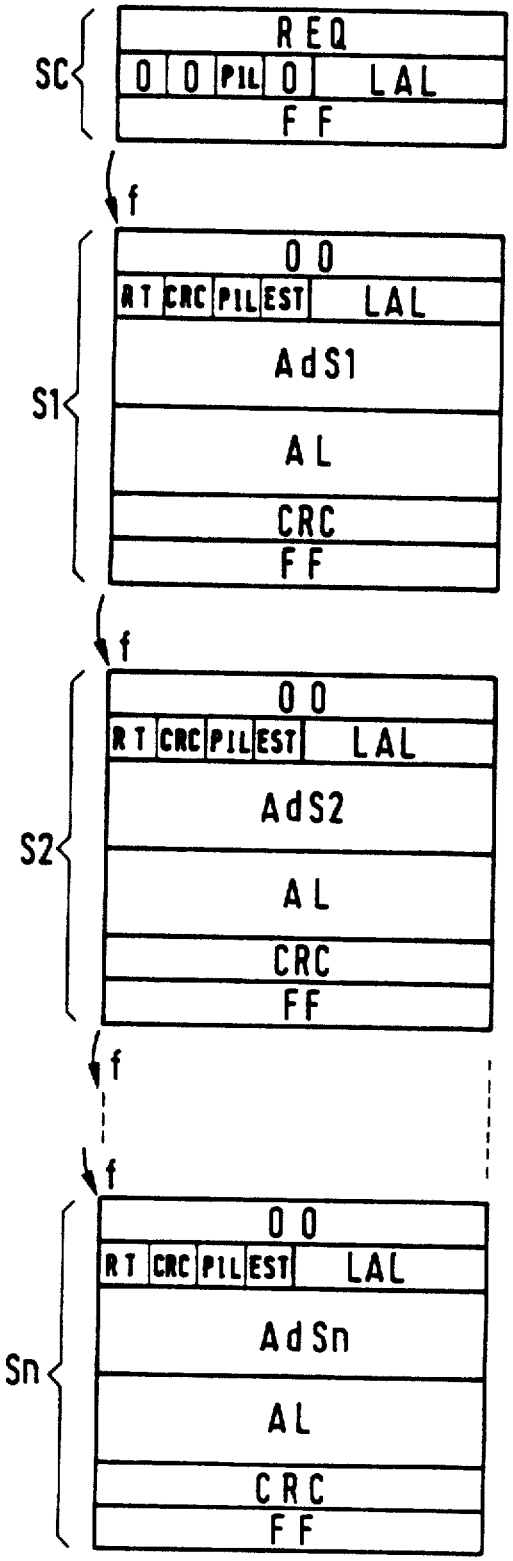
FIGS. 5 to 10 show messages intended for stations in the system of the invention shown in FIGS. 2 to 4, with FIG. 5 relating to an alarm-reading message, FIG. 6 relating to an initialization message, FIG. 7 relating to a remote control message, FIG. 8 relating to a test message, FIG. 9 relating to a non-identified bytes message, and FIG. 10 relating to a set alarm indicator lamps message.

FIG. 5 relates to the read alarms message.

This message transmitted by the central station SC is constituted by two bytes: the first byte REQ is a transmit request, and the second byte is split into half-bytes, one of which includes a 1-bit flag PIL and three 0-bits, and the other of which, referenced LAL, specifies the nature of the message, i.e. a "read alarms" message, with the central station SC sending a byte FF after the message to constitute an end-of-message flag.

This message is received by the first station S1 of the set of n stations. The station S1 forwards the two message bytes transparently. The FF tells the station that transmision, and thus the message is transmitted, so the station S1 transmits its reply following the two message bytes transmitted by the central station SC. This reply comprises six bytes, with the first byte of value 0 replacing, as indicated by arrow f, the byte FF transmitted by the central station after its message. At the end of its own reply, the station S1 transmits a byte of value FF which constitutes an end-of-transmision flag.

The next station, S2, receives the first two bytes of the message which it forwards transparently; thereafter it receives the 0 value first byte of the reply from the station S1; this byte tells us the station S2 that a reply is present; the station S2 therefore forwards this byte and the following bytes transparently; when it receives the end-of-transmission flag, it inserts is own reply following the reply from the station S1. This reply likewise begins with a byte of value 0 which, as indicated by arrow f, replaces the byte FF, and after its own reply, the station S2 transmits a new byte FF which constitutes an end-of-transmission flag.

The following stations proceed in the same manner. The station Sn which is the last station of the set of n stations transmits a reply whose first byte is of value 0 and it follows its reply with a byte of value FF constituting an end-of-transmission flag.

The central station SC receives an alarm message from the last station Sn and constituted by the first two bytes of the transmitted instruction followed by the successive replies from the stations and followed by the end-of-transmission flag, i.e. the byte FF. This tells the central station not to expect any further replies.

The byte containing the mention FF thus informs any station which receives it that it is the last byte emitted by the preceding station, and consequently that the receiving station can in turn transmit its own reply which, as mentioned, begins with a 0 value byte transmitted in the position of the received FF byte. When a station receives a 0 byte, this byte tells the station that there follows a reply from a preceding station, which reply must be forwarded transparently.

Each reply from a station is constituted by seven bytes as follows:

a first byte of value 0;

a second byte split into two half-bytes; one of the half-bytes, LAL, specifying the nature of the message constituted by the reply, and the other half-byte comprising 1-bit flags as follows:

- a flag RT specifying the result of an aurotest on the interface I;
- a flag CRC giving the result of the cyclic redundancy check performed on all of the preceding bytes received by the station;
- a flag PIL specifying the state of the interface, i.e. active or standby, this flag has the value 1 to indicate active and the value 0 to indicate standby; and
- a flag EST which indicates a framing format error, with the term "frame" indicating the entire set of bytes received by a station;

third and fourth bytes containing the address Ad Si of the station;

fifth and sixth bytes containing the states of the alarm wires of the station; and a seventh byte, CRC, containing the value of the cyclic redundancy check calculated on the entire reply of the station.

Figure 6:
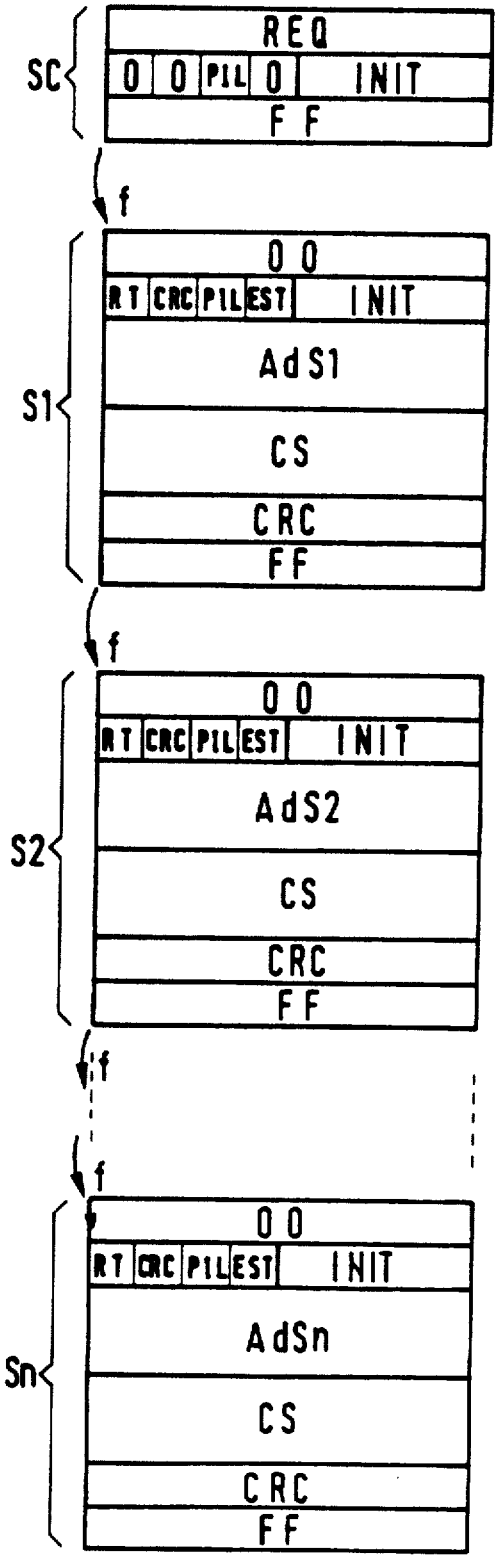

FIG. 6 relates to an initialization message. This message is transmitted by the central station SC in order to discover the configuration of the message loop, i.e. the order in which the stations follow one another. The initialization message is transmitted at the initiative of an operator when the message loop is being created or extended, or else during maintenance. The initialization message serves to verify that the stations are in the same order as that specified in a message loop configuration file. If the central station detects a mismatch, it indicates that there is a fault on the message loop with a parameter specifying the point at which it starts to differ from the configuration file. The initialization process is identical to the alarm reading process except that the reply format is different insofar as it omits alarm indication.

Like the read alarms message, the initialization message comprises a transmission-request first byte REQ, and a second byte split into two half-bytes, one of which comprises three 0 bits and a PIL flag, and the other, referenced INIT, specifies that the message is an initialization message. Following these two bytes, the central station SC transmits an end-of-transmission flag which is a byte FF.

The reply from each station comprises seven bytes, the first of which is zero in value, the second of which is split into two half-bytes, one of which is referenced INIT and specifies the nature of the reply, and the other of which comprises the same flags RT, CRC, PIL, and EST as the reply to a read alarms instruction, the third and fourth bytes contain the address Ad Si of the station transmitting the reply, the fifth and sixth bytes contain the check sum of the software loaded in the interface, as contained in one of the words of the microprocessor program memory, and the seventh byte CRC contains the value of the cyclic redundancy check calculated on the entire reply of the station.

On initialization, each interface I that receives the initialization message performs an autotest. For the program memory of the microprocessor, the autotest consists in calculating a check sum and in verifying whether it matched the check sum situated at the end of the program zone in the memory. The fact that each station includes the check sum CS in its reply to the initialization message enables the central station to check which version of the software is present in the program memory.

Figure 7:
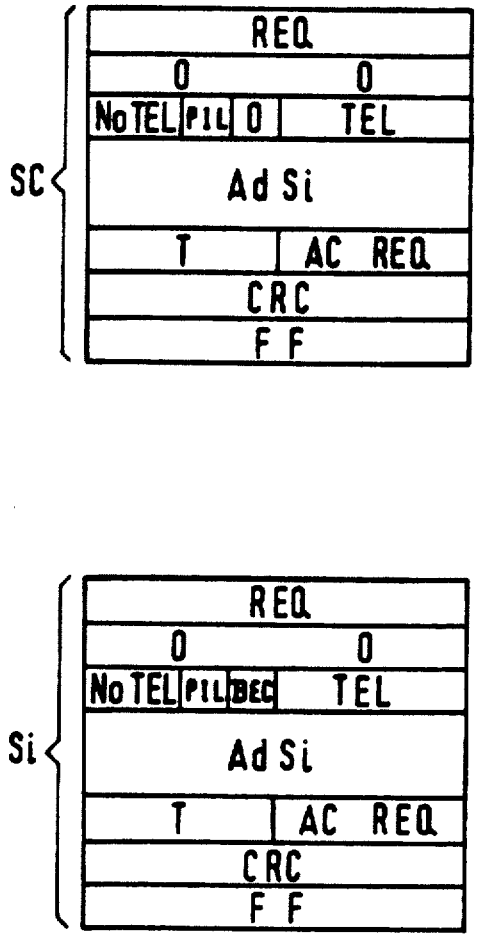

FIG. 7 relates to an execute remote control message which is a message intended for a station specified by its address together with an indication of the requested action.

This message begins with a transmission-request first byte REQ which is followed by the remote control message comprising:

a zero second byte;

a third byte split into two half-bytes, one of which, referenced TEL, specifies the nature of the message, i.e. a request to execute remote control in this case, and the other of which includes a zero value bit, a 1-bit flag PIL, and the number, No TEL, of the request to execute remote control, said number occupying two bits and being used in the event that the execution request is repeated;

fourth and fifth bytes referenced Ad Si specifying the address of the destination station for the message;

a sixth byte split into two half-bytes, one of which is referenced ACREQ and specifies which remote control is being requested in the station of address Si (this half-byte serves to select one out of several possible actions at the station Si), and the other half-byte, referenced T, specified the execution time of the requested remote control; and a seventh byte, referenced CRC, containing the value of the cyclic redundancy check calculated on the six preceding bytes.

The message is followed by an end-of-message FF byte specifying the end of transmission.

Each station whose address does not correspond to Ad Si relays the message transparently. When the message reaches its destination station, this station waits until it has detected the byte FF, then activates the remote control specified in the message, verifies that it has been indeed activated, and then retransmits a reply in which the flag BEC (execution OK) is set to 1. The reply is followed by a byte FF.

This reply consists in retransmitting the received remote control message, i.e. the seven message bytes with the flags BEC and PIL in the third byte being set, said flag BEC corresponding to the zero value bit transmitted in the half-byte, and with the seventh byte, CRC, containing the value of the cyclic redundancy check as calculated by the station. The reply is followed by a byte FF.

Naturally, the reply is relayed transparently by all the following stations. After sending a remote control request message, the central station therefore receives the REQ byte it transmitted followed by the reply as transmitted by the station to which the remote control message was sent, followed by a byte FF.

Figure 8:
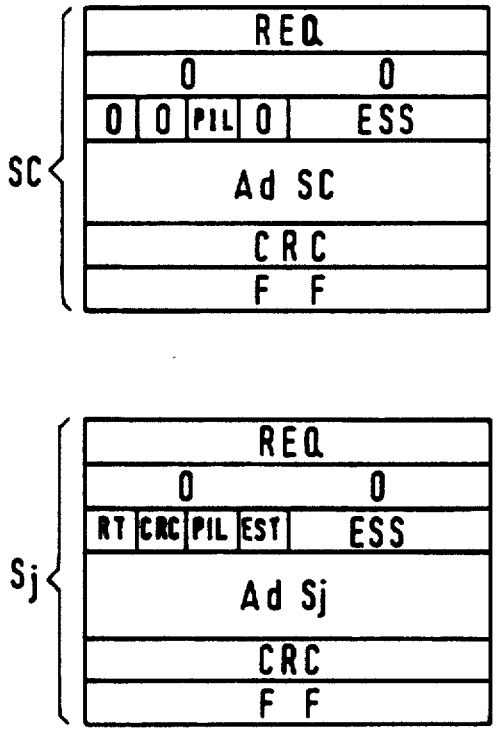

FIG. 8 relates to a test message. This message as transmitted by the central station SC comprises six bytes: the first byte REQ is a transmission-request byte, the second byte is zero, the third byte is split into two half-bytes one of which, referenced ESS, specifies the test nature of the message and the other of which includes a flag PIL and three zero value bits; the fourth and fifth bytes contain the address of the central station SC, and the sixth byte, referenced CRC, contains the value of the cyclic redundancy check as calculated on the preceding five bytes. At the end of the message, an FF byte marks the end of the message. Any station Si which receives this message and which has not detected any anomaly retransmits the message unchanged. Should a station Sj detect an anonaly, it does not retransmit the message as received, but replaces the address of the central station in the message as received with its own address and sets appropriate flags to enable the central station to determine both the origin and the type of the fault, and in the sixth byte referenced CRC, the value of the cyclic redundancy check as calculated by the central station is replaced by the value of the cyclic redundancy check as performed by the station Sj.

Thereafter, all stations which receive the message retransmit it unchanged even if they have themselves detected an anonaly. This ensures that the message from the station Sj is conveyed all the way to the central station. Thus, unlike an alarm message, a test message does not lengthen as it goes round the message loop BM.

Figure 9:
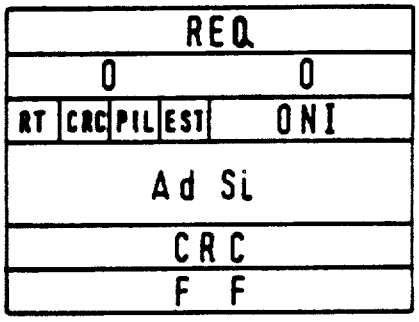

FIG. 9 relates to a non-identified bytes message which is transmitted by a station Si whenever it has not received a continuity byte for a certain length of time, or whenever it has received two successive non-identified bytes. In addition to transmitting messages, the central station and the stations periodically transmit continuity bytes. A station which no longer receives this byte assumes that there is a fault upstream. The non-identified byte message comprises six bytes: an REQ first byte, a zero second byte, a third byte split into two half-bytes, one of which is referenced ONI and specifies the "non-identified bytes" nature of the message being transmitted, and the other of which contains flags RT, CRC, PIL, and EST set by the station, the third and fourth bytes referenced Ad Si contain the address of the station Si, and the sixth byte referenced CRC contains the cyclic redundancy check value calculated on the five preceding bytes. A byte FF is transmitted after the message.

The following stations retransmit this message without adding any reply thereto.

Figure 10:
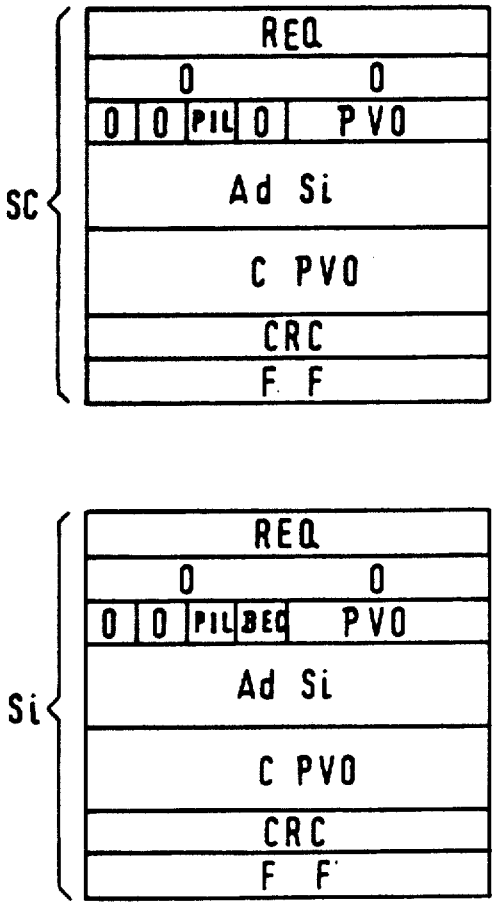

FIG. 10 relates to the set indicator lamps message. This message is transmitted by the central station SC and is intended for a station specified by its address. The procedure is the same as for an execute remote control message. The set indicator lamps message is constituted by eight bytes; the first byte, REQ, is a transmission-request byte, the second byte is zero, the third byte is split into two half-bytes, one of which is referenced PVO and specifies the "set indicator lamps" nature of the message, and the other of which includes a flag PIL and three bits set to zero, the fourth and fifth bytes are referenced Ad Si and specify the address of the destination station, the sixth and seventh bytes referenced CPVO specify which alarm lamps are to be switched on, and the eighth byte, referenced CRC, specifies the value of the cyclic redundancy check performed on the seven preceding bytes.

The reply from the destination station also includes eight bytes; the first and second bytes are identical to the first and second bytes of the message; the third byte is split into two half-bytes, one of which is referenced PVO and specifies the "set indicator lamps" nature of the message, and the other of which comprises two 0-bits and two flags PIL and BEC, with the flag BEC indicating that the set indicator lamps request has been properly performed; the fourth, fifth, sixth, and seventh bytes are identical to the corresponding bytes of the message, and the eighth byte, referenced CRC, contains the value of the cyclic redundancy check as calculated on the seven preceding bytes. The byte FF is transmitted after the reply.

As indicated above, each interface includes its own power supply. Thus, any manipulation of a station such as plugging it in, unplugging it, or switching it off, will generate a disturbance in the alarm collecting system as a whole. This disturbance is detected by the central station which then performs a reset-to-zero operation via the loop BCE in order to realign the alarm collecting system as a whole.

When the n stations of the set of stations are switched on, or following a general reset-to-zero under the control of the central station via the state control loop BCE, each interface performs an autorest, reads the alarms of its own station, and in anticipation prepares its reply to an instruction from the central station SC. Each interface then stands by for the transmission-request byte REQ and on receiving the byte REQ, it analyzes the following byte. If the following byte is not zero, as applies to the read alarms message and the initialization message, it specifies the nature of the message. Otherwise if this byte is zero, the interface analyzes the following byte in order to discover the nature of the message: execute remote controls; test; non-identified bytes; or set indicator lamps.

Read alarms message.

In order to be informed about the alarms at each of the stations, the central station periodically transmits a transmission-request byte REQ followed by a byte specifying the nature of the request, followed by a byte FF. An interface which has received the first two bytes and which has thus detected the nature of the instruction, next receives a byte which is either zero or FF, depending on whether or not the message is followed by a reply. On detecting a byte FF, an interface knows that the transmission from the preceding station has terminated. A zero byte indicates to the station that it must relay the zero byte and the following bytes transparently. An FF byte indicates to the station that if is to transmit its own reply followed by an FF byte. After transmitting its reply, the station interface performs its autotest, reads the station alarms, prepares its next reply, and waits to receives a new message.

Initialization message.

As mentioned above, this message is not periodic, but like the read alarms message, it is addressed to all stations and each of them inserts its reply one after the other.

Execute remote control.

When the central station SC wishes to control an action at a station, it transmits a remote control message over the message loop followed by an FF byte.

The nature of the message is contained in the byte following the zero byte. On discovering that the message is a remote control request, the station interface compares its own address with the address it receives. If there is a mismatch, the message is merely relayed to the following station. If there is a match, then the remote control request is intended for that station. Prior to performing the remote control instruction, the interface verifies that its own autotest considers the interface not to be faulty and that the cyclic redundancy check of the message is correct.

Confirmation that a remote control instruction has been properly executed is given by setting the BEC flag (control properly executed) in the reply to the remote control message. If the central station does not receive this confirmation it repeats its remote control request.

When a station has detected a remote control message intended for that station, it waits to receive the byte FF indicating the end of the message. It then transmits its own reply followed by a byte FF. Thereafter the station interface performs its own autotest, reads the station alarms, prepares its next reply, and waits for a new message from the central station.

Test message.

This message is used when the interfaces are operating in standby mode. It is transmitted periodically by the central station. In the example shown in FIG. 4 where each station has two interfaces I1 and I2, this message is transmitted solely on the message loop for the interfaces on standby. So long as none of the interfaces on standby detects an anomaly, the message is relayed unaltered.

When a first interface Sj detects an anomaly, it relays the message, substituting its own address for the address of the central station and setting one or more flags for specifying the observed anomaly or anomalies, and it also recalculates the cyclic redundancy check CRC. The following stations relay the message unaltered, even if they too have detected anomalies.

Non-identified bytes message.

This message is transmitted spontaneously by an interface which has not received any bytes for a certain period of time, or which has received two non-identified bytes in succession. Stations situated downstream relay this message unaltered to the central station SC without adding any reply thereto.

Set indicator lamps message.

This message is transmitted by the central station SC in order to set alarm indicator lamps at a station. This message therefore contains the address of the destination station. Each station which receives this message compares its own address with the received address.

All messages include a PIL flag. This flag is determined on transmission of the message: it has the value 1 for active operation and the value 0 for standby operation. Its value is determined by the central station except in the case of non-identified bytes messages since those messages are generated by one of the other stations. Each interface which receives a message checks the state of the state control loop BCE whose signal has the value 1 for active operation and the value 0 for standby operation, and it determines the value of the flag PIL in its reply as a function of the state of the loop BCE. For each reply, the central station verifies that the state of the BCE loop corresponds to the PIL flag, and if they do not correspond the central station SC sets the state control loop BCE to the standby state so that the signal on this loop takes the value 0 and the interface on it switch from active to standby. It should be observed that differences may arise when the BCE loop is already in the standby state, and in this case the state of the loop does not change. In the embodiment shown in FIG. 4, where each station has two interfaces I1 and I2, changing the state of one of the state control loops causes the state of the other loop to change as well such that the active interfaces switch over to standby, and vice versa.

The system of the invention processes anomalies. Any anomaly observed by an interface is signalled to the central station SC by the flags contained in the reply from a station. This enables the central station to locate a fault on the message loop.

No reception.

Each interface checks for lack of reception by means of a continuity byte. Injecting this byte provides a simple solution to problems associated with the continuity of the loops BM, BCE, and BH being interrupted, and also to problems related to faults in the serial ports of the interfaces I and of the central station.

Periodically, each interface transmits a continuity byte over the message loop towards the following interface. When an interface no longer receives this byte or receives two non-identified bytes in succession, it takes the initiative to send a "non-identified bytes" message. The following stations retransmit this message unaltered without adding any reply thereto, thereby enabling the central station SC to locate the break given the station address contained in the message which it receives.

Wrong CRC (cyclic redundancy check).

Each interface recalculates the CRC for the replies of the preceding stations. Detection of a wrong CRC is indicated to the central station by setting the CRC flag in the reply transmitted by the interface. This procedure makes it easy to detect and locate the position on the message loop from which the fault originates.

Framing errors (EST).

These are anomalies as seen by the software of the microprocessor in an interface on receiving messages, for example the absence of a zero byte or an FF byte.

In the event of a framing error, the interface which detects it ceases to relay anything it receives and it transmits a reply of the kind used in reply to a read alarms message, and in which the EST flag is set. Thereafter, it waits for reinitialization from the central station SC, Test result (RT).

This flag is set to 1 by the microprocessor whenever it considers that the entire interface is in perfect working condition. This state is determined by an on-line test.

We claim:

1. A system for collecting alarms from a set of n stations each specified by an address, said system comprising:

a central station where alarms are brought together;

a first and a second interface in each station;

means connecting all said first interfaces in series with the central station via a first loop and for connecting all said second interfaces in series with the central station via a second loop link; each loop link comprising:

a message loop conveying messages transmitted by the central station to at least one of the interfaces, and messages emitted by the interfaces to the central station;

a state control loop conveying a state control signal delivered by the central station to set one of an active and standby operating mode in all of the interfaces; said active operating mode enabling an interface to be remotely controlled by the central station, said standby operating mode disabling an interface to be remotely controlled, but for test purposes said first interfaces and said second interfaces being respectively in said two operating modes; and a clock signal loop conveying a clock signal delivered by the central station to all of the interfaces.

2. A system for collecting alarms according to claim 1, wherein each interface of a station comprises a microprocessor and a parallel/series register having a parallel input connected to the output of an AND gate, an output connected to a data input of the microprocessor, and a clock input connected to a clock output from the microprocessor; wherein the AND gate has an input connected to the station via an alarm link and another input connected to a write output from the microprocessor; and wherein the microprocessor has a station address input connected to a station address circuit containing the address of the station, a receive input and a transmit output connected to the message loop, a remote control output connected via a remote control link to the station, a clock input connected to the clock signal loop, and a state control input connected to the state control signal loop connecting the central station to the station interfaces and conveying the state control signal delivered by the central station.

3. A system for collecting alarms according to claim 2, wherein the interface further includes an alarm output circuit having its output connected to the alarm link and having its input connected to the output from an AND gate having a first input connected to the data input of the microprocessor, a second input connected to the write output of the microprocessor, and a third input connected to a control output from the microprocessor, said alarm output circuit serving to test the alarm link during operation of the interface to collect alarms, and to transmit signals over the alarm link for setting alarm indicator lamps during operation of the interface for setting alarm indicator lamps.

4. A system for collecting alarms according to claim 1, wherein the central station delivers different types of messages over the loop: alarm read messages destined for all of the stations and transmitted periodically; remote control request messages destined for a particular station in order to perform a remote control operation in said destination station; a set indicator lamp message destined to a particular station in order to set the alarm indicator lamps of said destination station; an initialization message destined for all stations in order to discover the order in which the stations follow one another around the loop link; and a test message destined for all the stations and emitted periodically to discover any anomaly that may have been detected by the interfaces; the remote control request and set indicator lamps messages being transmitted only when the interfaces are operating in active mode; and the test message being transmitted only when the interfaces are operating in standby mode.

5. A system for collecting alarms according to claim 1 wherein the central station periodically transmits a continuity byte over the message loop and that an interface which does not receive said continuity byte transmits a non-identified byte message over the message loop towards the central station, said message including the address of the station comprising said interface.

6. A system for collecting alarms according to claim 1, wherein an interface which receives two non-identified bytes in succession over the message loop transmits a non-identified bytes message towards the central station, said message including the address of the transmitting station.

7. A system for collecting alarms according to claim 1, wherein each message transmitted by the central station includes a flag PIL whose value is determined by the central station as a function of the value of the state control signal in order to indicate the operating mode to which the interfaces are switched by the control signal loop.

8. A system for collecting alarms according to claim 1, wherein each reply from an interface and each message transmitted by an interface includes a flag PIL whose value is determined by the interface as a function of the value of the state control signal as received by said interface.

9. A system for collecting alarms according to claim 4, wherein the read alarms message comprises a transmission-request first byte, a second byte split into two half-bytes, one of which specifies the type of the message and the other of which contains three zero value bits and a 1-bit flag PIL whose value is determined by the central station as a function of the value of the state control signal; wherein an end-of-transmission one byte flag FF is transmitted following said message; wherein a reply to said message comprises: a zero value first byte; a second byte split into two half-bytes, one of which specifies the "read alarms" type of the reply, and the other of which comprises four 1-bit flags, namely a flag RT for the result of an autotest performed by the station interface, a flag CRC for the result of a cyclic redundancy check on the message and the replies as received by the station, a flag PIL for specifying the operating mode corresponding to the state control signal as received by the station, and a flag EST for indicating a framing error; third and fourth bytes containing the address of the station; fifth and sixth bytes for indicating the alarms of the station; and a seventh CRC byte for specifying the value of the cyclic redundancy check calculated on the reply of the station; wherein a first station receiving the message removes the end-of-transmission flag; following the message and inserts its reply following the message after which it adds its own end-of-transmission flag, and wherein thereafter each station removes the end-of-transmission flag following the preceding reply, inserts its own reply, and inserts its own end-of-transmission flag.

10. A system for collecting alarms according to claim 4, wherein the initialization message comprises: a transmission-request first byte; a second byte split into two half-bytes, one of which specifies the type of the message and the other of which contains three zero value bits and a 1-bit flag PIL whose value is determined by the central station as a function of the value of the state control signal; wherein a one byte end-of-transmission flag FF is transmitted following said message; wherein a reply to said message comprises: a zero value first byte; a second byte split into two half-bytes, one of which specifies the initialization type of the reply and the other of which comprises four one-byte flags: a flag RT for the result of an autotest performed on the interface of the station, a flag CRC for the result of a redundancy check on the message and the replies received by the station, a flag PIL for specifying the operating mode corresponding to the state control signal as received by the station, and a flag EST for indicating a framing error; third and fourth bytes containing the address of the station; fifth and sixth bytes specifying the value of the check sum on the software stored in memory; and a seventh byte for specifying the value of the cyclic redundancy check calculated on the reply of the station; wherein a first station receiving the message removes the end-of-transmission flag following the message, inserts its reply after the message, and adds its own end-of transmission flag; and wherein thereafter each station removes the end-of-transmission flag following the preceding reply, inserts its own reply, and adds its own end-of-transmission flag.

11. A system for collecting alarms according to claim 4, wherein the remote control message comprises: a transmission-request first byte; a zero second byte; a third byte split into two half-bytes, one of which specifies the remote control type of the message and the other of which specifies the number of the request, provides a zero bit, and provides a 1-bit flag PIL whose value is determined by the central station as a function of the value of the state control signal; fourth and fifth bytes containing the address of the station; a sixth byte split into two half-bytes, one of which specifies the requested remote control and the other of which specifies an execution time therefor; and a CRC seventh byte for specifying the value of the cyclic redundancy check calculated on the bytes of the message; wherein a one byte end-of-transmission flag is transmitted after said message; and wherein the destination station replies by relaying the message with the third byte containing the flag PIL set by the station to specify the mode of operation which corresponds to the state control signal as received, and a flag BEC replacing the zero value bit in order to specify that the remote control message has been properly executed, and in the sixth byte the value of the cyclic redundancy check as calculated on the reply, and then retransmitting the end-of-transmission flag.

12. A system for collecting alarms according to claim 4, wherein the test message comprises a transmission-request first byte; a zero value second byte; a third byte split into two half-bytes, one of which specifies the type of message and the other of which contains three zero value bits and a 1-bit flag PIL whose value is determined by the central station as a function of the value of the state control signal; fourth and fifth bytes containing the address of the central station; and a CRC sixth byte specifying the value of the cyclic redundancy check calculated on the bytes of the message; wherein a one byte end-of-transmission flag is transmitted after the message; wherein a station which has detected no anomalies relays the message and the end-of-transmission flag; and wherein a station which has detected an anomaly and which receives said test message transmits a reply comprising a transmission-request first byte which replaces an end-of-transmission flag as received by the station; a zero value second byte; a third byte split into two half-bytes, one of which specifies the type of the reply and the other of which comprises four 1-bit flags: a flag RT for the result of an autotest on the station interface; a flag CRC for the result of a cyclic redundancy check; a flag PIL for specifying the operating mode which corresponds to the state control signal as received by the station; and a flag EST for indicating a framing error; fourth and fifth bytes for specifying the address of the station; and a sixth byte for giving the value of the cyclic redundancy check calculated on the bytes of the station's reply; and wherein an end-of-transmission flag byte is transmitted following the reply.

13. A system for collecting alarms according to claim 4, wherein the non-identified byte message transmitted by a station comprises a transmission-request first byte; a zero value second byte; a third byte split into two half-bytes, one of which specifies the type of the message and the other of which comprises four 1-bit flags: a flag RT for the result of an autotest on the station interface; a flag CRC for the result of a cyclic redundancy check on the received bytes; a flag PIL for specifying the mode of operation which corresponds to the state control signal as received by the station; and a flag EST for indicating a framing error; fourth and fifth bytes for giving the address of the station; and a sixth byte for giving the value of the cyclic redundancy check calculated on the bytes of the reply; and wherein and end-of-transmission flag is transmitted after the message.

14. A system for collecting alarms according to claim 4, wherein the set indicator lamps message comprises a transmission-request first byte; a zero value second byte; a third byte split into two half-bytes one of which contains the type of the message and the other of which contains three zero value bits and a 1-bit flag PIL whose value is determined by the central station as a function of the value of the state control signal; fourth and fifth bytes giving the address of the destination station; sixth and seventh bytes for specifying which alarm indicator lamps are to be switched on; and an eighth byte giving the value of the cyclic redundancy check calculated on the bytes of the message; wherein an end-of-transmission flag is transmitted following the message; and wherein the destination station replies by retransmitting the message with the flag PIL in the third byte being given a value by the station to specify the mode of operation which corresponds to the state control signal as received thereby, and with a zero value 1-bit flag BEC whose value is determined to indicate that the set indicator lamps message has been properly executed; and with an eighth byte containing the value of the cyclic redundancy check calculated on the reply, and then retransmitting the end-of-transmission flag.

15. A system for collecting alarms according to claim 1, wherein both the clock signal and the state control signal travel in the same direction in each loop link, with messages travelling in the opposite direction to the clock signal and the state control signal.

* * * * *